United States Patent [19]

Kunze et al.

[11] 4,256,443

[45] Mar. 17, 1981

[54] ROTARY VANE-TYPE ENGINE THROTTLE CHANNELS COMMUNICATING BETWEEN ADJACENT WORKING SPACES

[75] Inventors: Lothar Kunze, Hofheim-Langenhain; Manfred Kahrs, Wiesbaden, both of Fed. Rep. of Germany

[73] Assignee: ITT Industries, Inc., New York, N.Y.

[21] Appl. No.: 31,907

[22] Filed: Apr. 20, 1979

[30] Foreign Application Priority Data

May 20, 1978 [DE] Fed. Rep. of Germany ..... 2822102

[51] Int. Cl.[3] ..... F01C 21/00; F03C 2/00; F04C 15/00

[52] U.S. Cl. ..... 418/77; 418/78; 418/180

[58] Field of Search ..... 418/75, 77, 78, 180, 418/189

[56] References Cited

U.S. PATENT DOCUMENTS

| | | | |
|---|---|---|---|
| 2,588,430 | 3/1952 | Svenson | 418/77 |
| 2,762,312 | 9/1956 | Adams et al. | 418/78 |
| 2,778,317 | 1/1957 | Cockburn | 418/78 |
| 2,855,857 | 10/1958 | Sung | 418/77 |
| 3,204,564 | 9/1965 | Eltze | 418/78 |
| 3,799,707 | 3/1974 | Newton | 418/77 |

FOREIGN PATENT DOCUMENTS

| | | | |
|---|---|---|---|
| 405613 | 11/1909 | France | 418/180 |

*Primary Examiner*—John J. Vrablik

*Attorney, Agent, or Firm*—John T. O'Halloran; Thomas N. Twomey

[57] ABSTRACT

A rotary vane-type engine includes a rotor, a cam ring surrounding the rotor, and working vanes slidably disposed in radial slots of the rotor and engaging with one of their ends the inner contour of the cam ring. The vanes subdivide the space formed between the rotor and the cam ring into working spaces which are limited axially by side plates. Control ports provided in the side plates have throttle channels which extend in the rotor circumferential direction and connect the working spaces arranged on either side of the throttle channel with each other.

10 Claims, 7 Drawing Figures

ROTARY VANE-TYPE ENGINE THROTTLE CHANNELS COMMUNICATING BETWEEN ADJACENT WORKING SPACES

BACKGROUND OF THE INVENTION

1. Field of the Invention

This invention relates to a rotary vane-type engine with a rotatable rotor having radial slots in which working vanes are guided for radial displacement therein, the vanes having radially outwardly directed end surfaces for abutting engagement with the inner contour of a cam ring surrounding the rotor, the vanes subdividing the chamber formed between the cam ring and the rotor into working spaces, with side plates being provided which abut against the front surfaces of rotor and cam ring and include control ports for the supply and discharge of fluid, and with a throttle channel provided at the end of the control port extending in the rotor circumferential direction, the throttle channel permitting communication between the working spaces arranged on either side of the throttle channel.

2. Description of the Prior Art

From U.S. Pat. No. 2,588,430, a rotary blade pump is known which includes a rotatable rotor having radial slots therein. The slots receive radially displaceable working blades having radially outwardly directed end surfaces adapted for abutting engagement with the inner contour of a cam ring surrounding the rotor. The working blades subdivide the chamber formed between the rotor and the cam ring into working spaces. The front surfaces of rotor and cam ring are in contact with side plates in which control ports for the supply and discharge of fluid are provided. The fluid discharge ports are provided with a throttle notch at one of their ends extending in the rotor circumferential direction, the length of the notch extending in the rotor circumferential direction being greater than the width of the working blades.

If, during operation of the rotary blade pump, a working blade overtravels the throttle notch, the working spaces on either side of the working blade are in communication with each other through the throttle notch so that the low-pressure working space is pressurized to the pressure prevailing in the high-pressure working space.

This pressurization occurs during a very short period within which the distance covered by the working blade in the rotor circumferential direction is shorter than the amount of width of the working blade. It is within this short period within which the low-pressure condition changes to a high-pressure condition that peak pressures and compressional vibrations occur which cause disturbing noise.

SUMMARY OF THE INVENTION

It is, therefore, the object of the present invention to provide a rotary vane-type engine of the type initially referred to which largely precludes the occurrence of peak pressures and compressional vibrations during the change from a low-pressure to a high-pressure condition and vice versa.

According to the present invention, this object is achieved by arranging for the maximum effective throttle length of the throttle channel to be greater than the width of the working vanes. This permits the development of pressure in the low-pressure working space within a relatively long interval, because the distance covered by the working vane in the rotor circumferential direction is greater than the amount of width of the working vane. The occurence of disturbing noise and pulsations in the fluid flow is thus largely avoided.

The present invention may be employed particularly advantageously for rotary vane-type engines running at high rotational speeds, because in these engines the intervals within which the pressure change occurs are particularly short and may be prolonged substantially by the invention.

The throttle channel is advantageously provided in the area of the side plate which is covered by the rotor. In this arrangement, the throttle length is completely independent of the width of the working vanes so that working vanes with a very small width may also be used.

In an advantageous embodiment of the present invention, the throttle channel has its end remote from the control part connected with the chamber formed between the cam ring and the rotor. In this arrangement, the throttle channel may be a throttle slot extending in the rotor circumferential direction. As regards the process of pressurization of the low-pressure working space, the embodiment has the advantage of the throttle having a large effective length at the beginning of this process, which length becomes reduced in the further course of rotor rotation. This permits an even pressurization of the low-pressure working space.

In accordance with the invention, the rotor may have recesses disposed between the working vanes and opening into the respective working space, through which recesses the throttle channel is connectable with the respective working space,. The recesses may be provided in the rotor front surfaces or, alternatively, they may be designed as grooves extending over the whole axial width of the cylindrical surface area of the rotor. Both embodiments afford ease of manufacture.

In order to permit a reduction in the amount of extension, in the rotor circumferential direction, of the recesses opening into the working spaces, the rotor front surface may be provided with slots which are in communication with the recesses, extend in the rotor circumferential direction and connect the throttle channels with the recesses.

To further influence the course of pressurization of the low-pressure working space, the throttle slot may be of different cross-section over its length.

One embodiment of the present invention will be described in greater detail in the following with reference to the accompanying drawings.

DESCRIPTION OF THE INVENTION

Figure 1:
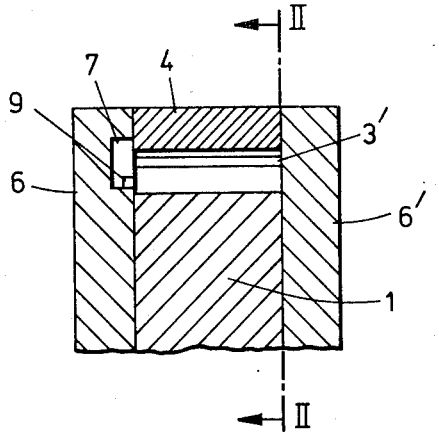
FIG. 1 is a fragmentary view, in section, of a rotary vane-type engine constructed in accordance with the invention, taken along the line I—I of FIG. 2.

The Figures are fragmentary view of rotary vane-type engines constructed in accordance with the invention and including a rotatable rotor 1 in which radial slots 2 are formed. The slots 2 receive radially displaceable working vanes 3, 3', 3'', 3''' having outwardly directed end surfaces for abutting engagement with the inner contour of a cam ring 4 surrounding the rotor 1. The chamber formed between the rotor 1 and the cam ring 4 is subdivided into working spaces 5, 5', 5'' by the working vanes 3, 3', 3'', 3'''. The front surfaces of rotor 1 and cam ring 4 are in abutment with side plates 6,6' in which kidney-shaped control ports 7 and 8 are provided for the supply and discharge of fluid.

Figure 2:
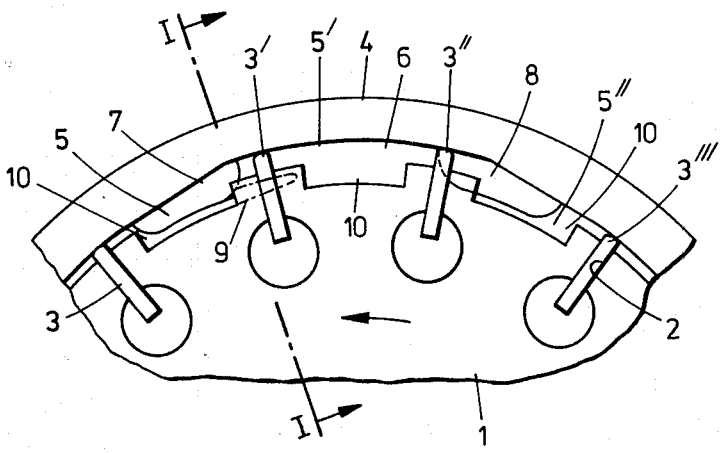
FIG. 2 is a view of the object of FIG. 1, taken along the line II—II.

In the embodiment illustrated in FIGS. 1 and 2, a throttle slot 9 is provided in the side plate 6 at an end of the control port 7 extending in the circumferential direction, the throttle slot extending in the rotor circumferential direction and being of a length which is a multiple of the width of the working vanes 3, 3', 3'', 3'''. The throttle slot 9 is formed in the area of the side plate 9 which is covered by the rotor 1. A groove extending over the whole axial width of the cylindrical surface area of the rotor 1 forms a recess 10 of such depth that the recess 10 overlaps with the throttle slot 9 during rotor 1 rotation, thereby establishing a connection between the two working spaces 5 and 5'.

Figure 4:
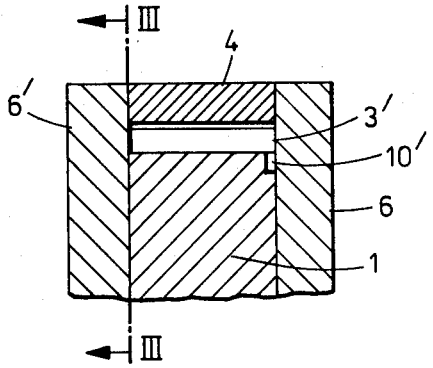
FIG. 4 is a view, in section, of the object of FIG. 3, taken along the line IV—IV.
Figure 3:
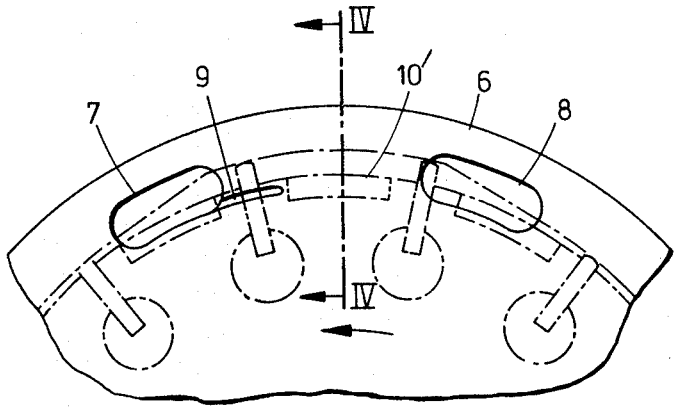
FIG. 3 is a view of a second embodiment of a rotary vane-type engine of the invention, taken along the line III—III of FIG. 4.

In the embodiment illustrated in FIGS. 3 and 4, a throttle slot 9 is provided in the side plate 6 in the manner illustrated in FIGS. 1 and 2. The recess 10' in FIGS. 3 and 4 differs from the recess in the first embodiment. It consists of a cavity formed in the rotor front wall and open radially outwardly, which cavity, similar to the recess 10 in FIGS. 1 and 2, overlaps with the throttle slot 9 during rotation of the rotor 1.

Figure 5:
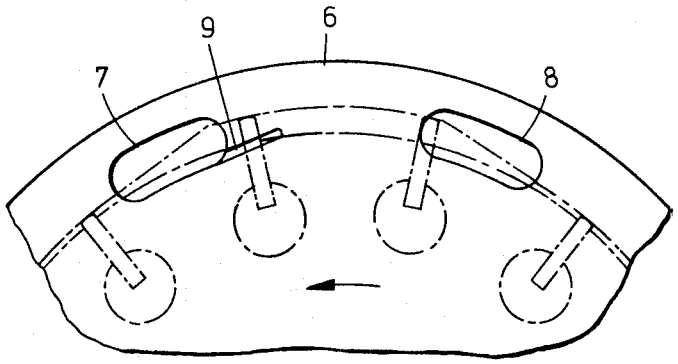
FIG. 5 is a view of a third embodiment of a rotary vane-type engine of the invention, in accordance with the view of FIG. 3.

In the embodiment of FIG. 5, the throttle slot 9' is so formed in the side plate 6 that its end opening into the control port 7 lies in the side plate 6 area which is covered by the rotor. The throttle slot 9' extends approximately tangentially with respect to the rotor periphery so that its other end extends out of the area covered by the rotor 1 and opens into the chamber between rotor 1 and cam ring 4. This embodiment requires no recess on the rotor 1.

Figure 6:
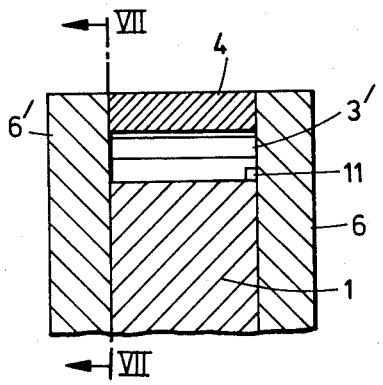
FIG. 6 is a view, in section, of a fourth embodiment of a rotary vane-type engine of the invention, taken along the line VI—VI of FIG. 7.
Figure 7:
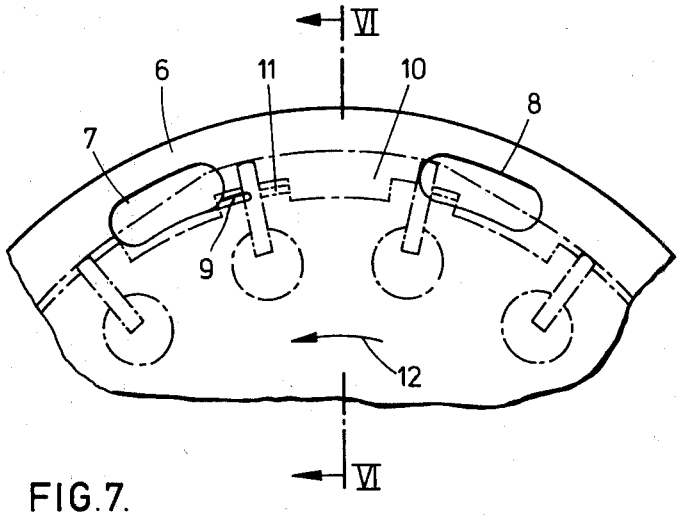
FIG. 7 is a view of the object of FIG. 6, taken along the line VII—VII.

The embodiment illustrated in FIGS. 6 and 7 includes a throttle slot 9 in the side plate 6 and a recess 10 in the rotor 1 which are identical with the throttle slot 9 and the recess 10 of the embodiment of FIGS. 1 and 2. In addition, the rotor 1 includes a slot 11 extending from the recess 10 in the direction of rotation 12 such that it overlaps with the throttle slot 9 during rotation of the rotor 1.

The mode of operation is in principle the same in all embodiments. If the rotary vane-type engine operates as a pump, the control port 8 is connected to the suction port and the control port 7 is connected to the pressure port of the pump. During overtravelling of the control port 8, fluid is drawn into the respective working space 5'', while fluid under pressure is urged out of the working space 5 into the control port 7.

In order to maintain the speed at which the pressure changes from a low-pressure condition, as it prevails in the working space 5', to a high-pressure condition, as it prevails in the working space 5, at a low value, the throttle slot 9 or 9' establishes a connection between the working spaces 5 and 5' during the period of time in which the working vane 3' overtravels the throttle slot 9 or 9'. During this period, an even pressurization of the working space 5' is possible.

Since, as a result of the long length of the throttle slot 9 or 9', a large time interval is available for this pressurization process and since the throttle length of the throttle slot 9 or 9' is large as the commencement of this process and becomes smaller as this process continues its course, the speed at which the pressure changes from a low-pressure to a high-pressure condition is maintained low. As a result, the occurrence of peak pressures and pressure pulsations and consequent noise is thus largely avoided.

What is claimed is:

1. A rotary vane-type engine, comprising:

a rotatable rotor having radial slots;

working vanes disposed in said slots and guided for radial displacement therein;

a cam ring surrounding the rotor and having an inner contour surface, whereby a chamber is formed between the cam ring inner contour surface and the rotor, said vanes having radially outwardly directed end surfaces for abutting engagement with the inner contour surface of the cam ring for subdividing the chamber into working spaces;

side plates for abutting against the front surfaces of said rotor and cam ring and including control ports for the supply and discharge of a fluid;

throttle channels associated with selected control ports and formed at the end thereof and extending in the rotor circumferential direction for permitting communication between adjacent working spaces when said working spaces are in communication with a throttle channel; and means associated with said rotor for effecting said communication and whereby the effective length to diameter ratio of the throttle channels is reduced as the rotor rotates and causes said working spaces to approach one of said selected control ports.

2. A rotary vane-type engine as described in claim 1, wherein the maximum effective throttle length of the throttle channel is greater than the width of the working vanes.

3. A rotary vane-type engine as described in claim 1 wherein the throttle channel is provided in an area of the side plate which is covered by the rotor.

4. A rotary vane-type engine as described in claim 1 wherein the effective length to diameter ratio of the throttle channel is dependent upon the portion of said throttle channel which is not in communication with said working space.

5. A rotary vane-type engine as described in claim 1 wherein the throttle channel comprises a throttle slot extending in the rotor circumferential direction.

6. A rotary vane-type engine as described in claim 5 wherein the throttle slot has a different cross-section over its length.

7. A rotary vane-type engine as described in claim 1, said communication means comprising recesses formed in said rotor and disposed between the working vanes, said recesses opening into the respective working spaces and being in communication with the throttle channel.

8. A rotary vane-type engine as described in claim 7 wherein the recesses are provided in the front surfaces of the rotor.

9. A rotary vane-type engine as described in claim 7 wherein the recesses are grooves formed in a cylindrical surface of the rotor and extending over the entire axial length thereof.

10. A rotary vane-type engine as described in claim 7, additionally comprising slots formed in the front surface of the rotor, said slots being in communication with the recesses and extend in the rotor circumferential direction for connecting the throttle channels with said recesses.

* * * * *